US005398514A

United States Patent [19]

Roberts et al.

[11] Patent Number: 5,398,514

[45] Date of Patent: Mar. 21, 1995

[54] CRYOGENIC RECTIFICATION SYSTEM WITH INTERMEDIATE TEMPERATURE TURBOEXPANSION

[75] Inventors: Mark J. Roberts, Grand Island; Neil M. Prosser, East Amherst; Robert A. Beddome, Tonawanda, all of N.Y.

[73] Assignee: Praxair Technology, Inc., Danbury, Conn.

[21] Appl. No.: 162,928

[22] Filed: Dec. 8, 1993

[51] Int. Cl.[6] ..... F25J 3/00

[52] U.S. Cl. ..... 62/38; 62/41

[58] Field of Search ..... 62/38, 41

[56] References Cited

U.S. PATENT DOCUMENTS

| | | | |
|---|---|---|---|
| 4,303,428 | 12/1981 | Vandenbussche | 62/13 |
| 4,407,135 | 10/1983 | Pahade | 62/13 |
| 4,410,343 | 10/1983 | Ziemer | 62/29 |
| 4,560,398 | 12/1985 | Beddome et al. | 62/29 |
| 5,108,476 | 4/1992 | Dray et al. | 62/24 |
| 5,148,680 | 9/1992 | Dray | 62/24 |
| 5,157,926 | 10/1992 | Guilleminot | 62/24 |
| 5,228,296 | 7/1993 | Howard | 62/22 |
| 5,233,838 | 8/1993 | Howard | 62/25 |
| 5,235,816 | 8/1993 | Parsnick et al. | 62/22 |
| 5,315,833 | 5/1994 | Ha et al. | 62/24 |

*Primary Examiner*—Ronald C. Capossela
*Attorney, Agent, or Firm*—Stanley Ktorides

[57] ABSTRACT

A cryogenic rectification system wherein feed partially traverses the primary heat exchanger, thereafter is turboexpanded, and then traverses another portion of the primary heat exchanger reducing the temperature differences between approaching streams within the primary heat exchanger and thus the cycle irreversibilities resulting in lower power requirements.

11 Claims, 1 Drawing Sheet

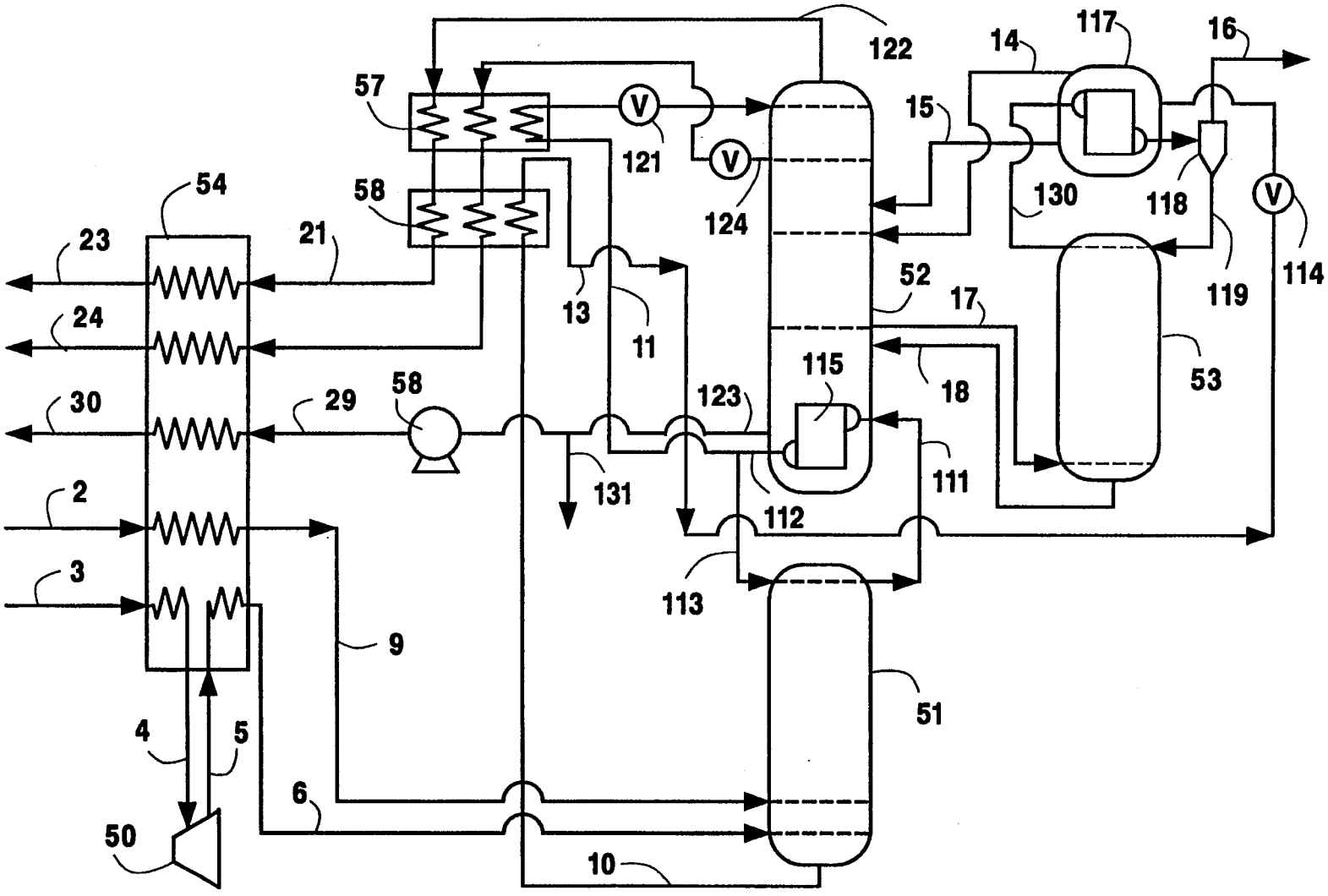
114
16
119
118
53
117
130
14
15
17
18
111
52
122
51
115
112
124
123
113
121
11
131
13
10
57
58
58
9
21
29
6
54
5
4
50
23
24
30
2
3

CRYOGENIC RECTIFICATION SYSTEM WITH INTERMEDIATE TEMPERATURE TURBOEXPANSION

TECHNICAL FIELD

This invention relates to generally to cryogenic rectification and more particularly to cryogenic rectification wherein liquid oxygen is vaporized.

BACKGROUND ART

Oxygen is produced commercially in large quantities by the cryogenic rectification of feed air, generally employing the well known double column system, wherein product oxygen is taken from the lower pressure column. At times it may be desirable to produce oxygen at a pressure which exceeds its pressure when taken from the lower pressure column. In such instances, gaseous oxygen may be compressed to the desired pressure. However, it is generally preferable for capital cost purposes to remove oxygen as liquid from the lower pressure column, pump it to a higher pressure, and then vaporize the pressurized liquid oxygen to produce the desired elevated pressure product oxygen gas.

Cryogenic rectification requires refrigeration in order to operate. The requisite refrigeration is increased when oxygen is withdrawn from the column as liquid and pumped prior to vaporization because the pump work is added to the system. Refrigeration may be provided to the cryogenic process by the turboexpansion of a stream fed into the rectification column system. However, the compression of a stream for the turboexpansion consumes a significant amount of energy.

Accordingly, it is an object of this invention to provide a cryogenic rectification system wherein liquid oxygen is removed from the column system for vaporization and wherein process refrigeration is provided by turboexpansion of a feed stream, which has improved operating efficiency over conventional oxygen systems.

SUMMARY OF THE INVENTION

The above and other objects which will become apparent to those skilled in the art upon a reading of this disclosure are attained by the present invention, one aspect of which is:

A cryogenic rectification method comprising:

(A) turboexpanding a feed air stream which has passed through a portion of a primary heat exchanger;

(B) passing the turboexpanded feed air stream through a portion of the primary heat exchanger whereby the feed air stream is cooled by passage through the primary heat exchanger;

(C) passing the cooled, turboexpanded feed air stream into the higher pressure column of a double column system of a cryogenic rectification plant;

(D) producing liquid oxygen by cryogenic rectification within the cryogenic rectification plant and passing liquid oxygen from the cryogenic rectification plant to the primary heat exchanger; and (E) vaporizing liquid oxygen within the primary heat exchanger and recovering product gaseous oxygen from the primary heat exchanger.

Another aspect of the invention is:

A cryogenic rectification apparatus comprising:

(A) a primary heat exchanger;

(B) a turboexpander;

(C) means for passing feed through a portion of the primary heat exchanger, from the primary heat exchanger to the turboexpander, from the turboexpander through a portion of the primary heat exchanger, and from the primary heat exchanger into the higher pressure column of a double column system of a cryogenic rectification plant;

(D) means for passing liquid from the cryogenic rectification plant to the primary heat exchanger; and (E) means for recovering vapor from the primary heat exchanger.

As used herein the term "primary heat exchanger" means a device, which may be a unitary piece or may comprise a plurality of pieces, wherein feed intended for passage into a cryogenic rectification column is cooled by indirect heat exchange with one or more streams taken from the column or from the column system of which the column is part.

As used herein the term "cryogenic rectification plant" means the columns wherein fluid is separated by cryogenic rectification as well as interconnecting piping, valves, heat exchangers and the like.

As used herein, the term "feed air" means a mixture comprising primarily nitrogen, oxygen and argon, such as air.

As used herein, the terms "turboexpansion" and "turboexpander" mean respectively method and apparatus for the flow of high pressure gas through a turbine to reduce the pressure and the temperature of the gas thereby generating refrigeration.

As used herein, the term "column" means a distillation or fractionation column or zone, i.e., a contacting column or zone wherein liquid and vapor phases are countercurrently contacted to effect separation of a fluid mixture, as for example, by contacting or the vapor and liquid phases on a series of vertically spaced trays or plates mounted within the column and/or on packing elements which may be structured packing and/or random packing elements. For a further discussion of distillation columns, see the Chemical Engineers' Handbook fifth edition, edited by R. H. Perry and C. H. Chilton, McGraw-Hill Book Company, New York, Section 13, *The Continuous Distillation Process.* The term, double column is used to mean a higher pressure column having its upper end in heat exchange relation with the lower end of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein, the term "argon column" means a column which processes a feed comprising argon and produces a product having an argon concentration which exceeds that of the feed and which may include a heat exchanger or a top condenser in its upper portion.

As used herein, the term "liquid oxygen" means a liquid having an oxygen concentration of at least 90 mole percent.

BRIEF DESCRIPTION OF THE DRAWING

The sole Figure is a schematic representation of one preferred embodiment of the cryogenic rectification system of the invention.

DETAILED DESCRIPTION

The invention serves to reduce the power requirement for a cryogenic rectification system wherein liquid oxygen is removed from the column system and vaporized to produce product gaseous oxygen. The invention involves turboexpanding a feed air stream and passing the turboexpanded feed air stream into the higher pressure column of a double column system. The invention enables a lower power requirement by providing a warmer turboexpander inlet temperature which causes the turboexpander to produce more work per unit flow. Since the refrigeration work required of the turboexpander and the flowrate through the turboexpander are essentially fixed by the refrigeration requirements of the plant, the invention results in a lower feed pressure requirement. The lower feed pressure enables a lower overall power requirement.

The turboexpander operating temperature level is optimized by choosing a temperature which results in a desired pinch, i.e., the minimum approach temperature between warming and cooling streams, in the cold leg of the primary heat exchanger and the stream exiting the turboexpander is reintroduced into the primary heat exchanger at the appropriate point for further cooling. The cold leg of the primary heat exchanger has a smaller temperature difference between the warming and cooling streams in the practice of this invention enabling the advantageous power reduction since large temperature differences in carrying out the heat exchange comprise a thermodynamic irreversibility which ultimately results in a higher power requirement.

The invention will be described in greater detail with reference to the Figure. Feed air streams 2 and 3 are passed into primary heat exchanger 54. Stream 2, which is the minor portion of the feed air and preferably comprises from about 26 to 35 percent of the feed air passed into the column system, is passed though primary heat exchanger 54 wherein it is cooled by indirect heat exchange with return streams. Resulting cooled feed air stream 9 is then passed into column 51 which is the higher pressure column of a double column system of the cryogenic rectification plant.

Stream 3 is the major portion of the feed air and preferably comprises from about 65 to 74 percent of the feed air passed into the column system. Stream 3 is passed through a portion, i.e. the warm leg, of primary heat exchanger 54 wherein it is cooled by indirect heat exchange with return streams and then is removed from primary heat exchanger 54 as stream 4. Within the warm leg of primary heat exchanger 54 the feed air is cooled from a temperature within the range of from 275 to 310 K. to a temperature within the range of from 130 to 180 K.

Cooled stream 4 is then turboexpanded by passage through turboexpander 50 to a temperature generally within the range of from 100 to 160 K. and then reintroduced into primary heat exchanger 54 as stream 5. This turboexpanded stream is then passed through a portion, i.e., the cold leg, of primary heat exchanger 54 wherein it is further cooled by indirect heat exchange with return streams to a temperature within the range of from 70 to 110 K. The cooled, turboexpanded feed air stream is then passed as stream 6 from the primary heat exchanger into column 51. Generally the turboexpanded feed air stream will comprise from 55 to 80 percent of the total feed air introduced into the cryogenic rectification plant.

As mentioned, column 51 is the higher pressure column of a double column arrangement. The double column system also includes column 52. Column 51 generally is operating at a pressure within the range of from 60 to 150 pounds per square inch absolute (psia). Within column 51, the feeds are separated by cryogenic rectification into nitrogen-enriched top vapor and oxygen-enriched bottom liquid. The cryogenic rectification plant illustrated in the Figure also includes a third column which in this case is an argon column for the production of crude argon. Nitrogen-enriched top vapor 111 is passed from column 51 into main condenser 115 wherein it is condensed against reboiling column 52 bottoms. Resulting condensed fluid 112 is passed in stream 113 as reflux into column 51, and in stream 11 through heat exchanger 57 and valve 121 into column 52 as reflux. Oxygen-enriched liquid is passed in stream 10 from column 51 through heat exchanger 58, wherein it is subcooled by indirect heat exchange with return streams, and resulting stream 13 is passed through valve 114 into top condenser 117 of argon column 53. In top condenser 117, the oxygen-enriched liquid is partially vaporized and the resulting vapor and remaining liquid are passed into column 52 in streams 14 and 15 respectively.

Column 52 is operating at a pressure less than that of column 51 and generally within the range of from 10 to 40 psia. Within column 52 the fluids fed into column 52 are separated by cryogenic rectification into nitrogen-rich vapor and oxygen-rich liquid, i.e. liquid oxygen. Nitrogen-rich vapor is withdrawn from column 52 in line 122, warmed by passage through heat exchangers 57 and 58 and then passed as stream 21 through primary heat exchanger 54. If desired, the nitrogen stream is recovered as product nitrogen 23 having a nitrogen concentration of at least 97 mole percent. For product purity control purposes, a waste stream 124 is withdrawn from column 52 at a point below the point where stream 122 is withdrawn, passed through heat exchangers 57, 58 and 54 and removed from the system as stream 24.

An argon containing fluid is passed from column 52 to argon column 53 in line 17, and is separated by cryogenic rectification in argon column 53 into argon-richer vapor and oxygen-richer liquid. The oxygen-richer liquid is returned to column 52 by line 18. Argon-richer vapor is passed in line 130 into top condenser 117 wherein it is partially condensed by indirect heat exchange with oxygen-enriched fluid. Resulting argon-richer fluid is passed into phase separator 118 and liquid 119 from phase separator 118 is passed into column 53 as reflux. Vapor 16 from phase separator 118 is recovered as product crude argon having an argon concentration of at least 95 mole percent.

Liquid oxygen is withdrawn from column 52 in line 123 and preferably is pumped to a higher pressure by passage through liquid pump 58 generally to a pressure within the range of from 40 to 1400 psia. The liquid oxygen in stream 29 is then passed through primary heat exchanger 54 wherein it is at least partially vaporized by indirect heat exchange with the cooling feed air. Resulting vaporized oxygen 30 is recovered as product oxygen gas having an oxygen concentration of at least 90 mole percent. The pressure of the product oxygen gas will vary, depending upon whether and how liquid pump 58 is employed, from the pressure prevailing at the column 52 withdrawal point to a pressure of about 1400 psia. If desired, some liquid oxygen may be recovered directly from the column system as indicated by line 131.

The following example is based on a computer simulation of the embodiment of the invention illustrated in the Figure. It is presented for illustrative purposes and is not intended to be limiting. The numerals referred to in the example correspond to those of the Figure.

Two clean dried compressed feed air streams 2 and 3 enter the main heat exchanger 54 at a temperture of 298 K. and a pressure of 110 psia. Stream 2 represents about 27 percent of the feed air and stream 3 represents about 73 percent of the feed air. Both streams enter the main heat exchanger separately at the warm end. Stream 4 is withdrawn from the main heat exchanger at an intermediate temperature of about 130 K. It is then expanded in expansion turbine 50 to a pressure approximately equal to the high pressure column 51 pressure of 78 psia. Stream 5 exits the turbine at a temperature of about 113 K. and is further cooled in the main heat exchanger to a temperature of about 78 K. before being introduced into the high pressure column 51. The smaller portion of the feed air 2 is cooled in the main heat exchanger 54 exiting as stream 9, a sub-cooled liquid at a temperature of about 78 K. It is then introduced into the elevated pressure column 51 at an intermediate point. Stream 2 is condensed in 54 while assisting in the vaporization of oxygen product stream 29. The elevated pressure column 51 is operated at a pressure of about 78 psia while the low pressure column 52 is operated at a pressure of about 19 psia as is the argon column 53. The system produces: (1) a high purity oxygen product stream 123 containing 99.96 percent oxygen exiting column 52 as a saturated liquid having a flow rate of about 21 percent of the feed air flow rate; (2) a high purity product nitrogen stream 122 which exits the top of column 52 as a saturated vapor containing about 1 ppm (molar) oxygen and having a flow rate of about 21 percent of the feed air flow rate; (3) an argon product stream 16 which exits the top of argon column 53 having a composition of about 97 percent argon and representing about 0.89 percent of the feed air flow rate; (4) a liquid oxygen product stream 131 which is split from the main oxygen steam 123 having a composition of about 99.96 percent oxygen and a flow rate of about 0.3 percent of the feed air flow rate; and (5) a waste stream 124 which exits the low pressure column 52 at an intermediate point and containing about 5 ppm of oxygen and exiting the low pressure column 52 as a saturated vapor.

Streams 121 and 124 are warmed to near ambient temperature in heat exchangers 57, 58 and 54. The liquid oxygen stream is increased in pressure from 1.3 atmospheres to about 2.4 atmospheres in device 58. This stream, now a sub-cooled liquid, is warmed to about 296 K. in heat exchanger 54 exiting as stream 30 for recovery as product.

Depending on the implementation, the middle zone of the primary heat exchanger may become important. The middle zone is that section of the primary heat exchanger between the point at which the feed 4 to the turboexpander is withdrawn and the point at which stream 5 is reintroduced. For high liquid recovery rates and/or high oxygen product pressures relatively more heat transfer surface is required, while for lower liquid recovery rates and/or lower oxygen product pressures, relatively less heat transfer surface can be effectively utilized. The invention enables the location of the turboexpander at the optimal temperature level and thus achieves a good match between cooling and heating duties in the heat exchange network, thus minimizing cycle irreversibilities and reducing the power requirement over that required by conventional systems.

Although the invention has been described in detail with reference to a certain preferred embodiment, those skilled in the art will recognize that there are other embodiments of the invention within the spirit and the scope of the claims.

We claim:

1. A cryogenic rectification method comprising:

(A) turboexpanding a feed air stream which has passed through a portion of a primary heat exchanger;

(B) passing the turboexpanded feed air stream through a portion of the primary heat exchanger whereby the feed air stream is cooled by passage through the primary heat exchanger;

(C) passing the cooled, turboexpanded feed air stream into the higher pressure column of a double column system of a cryogenic rectification plant;

(D) producing liquid oxygen by cryogenic rectification within the cryogenic rectification plant and passing liquid oxygen from the cryogenic rectification plant to the primary heat exchanger; and (E) vaporizing liquid oxygen within the primary heat exchanger and recovering product gaseous oxygen from the primary heat exchanger.

2. The method of claim 1 wherein the liquid oxygen is pumped to a higher pressure after withdrawal from the cryogenic rectification plant and prior to vaporization.

3. The method of claim 1 further comprising recovering a nitrogen-rich fluid from the cryogenic rectification plant.

4. The method of claim 1 further comprising recovering some liquid oxygen as product.

5. The method of claim 1 wherein the turboexpanded feed air stream comprises from 55 to 80 percent of the total feed air introduced into the cryogenic rectification plant.

6. The method of claim 1 further comprising passing an argon-containing fluid from the double column system into an argon column and recovering an argon-richer fluid from the argon column.

7. A cryogenic rectification apparatus comprising:

(A) a primary heat exchanger;

(B) a turboexpander;

(C) means for passing feed through a portion of the primary heat exchanger, from the primary heat exchanger to the turboexpander, from the turboexpander through a portion of the primary heat exchanger, and from the primary heat exchanger into the higher pressure column of a double column system of a cryogenic rectification plant;

(D) means for passing liquid from the cryogenic rectification plant to the primary heat exchanger; and (E) means for recovering vapor from the primary heat exchanger.

8. The apparatus of claim 7 wherein the means for passing fluid from the cryogenic rectification plant to the primary heat exchanger comprises a liquid pump.

9. The apparatus of claim 7 further comprising a third column, means for passing fluid from the double column system to the third column and means for recovering fluid from the third column.

10. The method of claim 1 further comprising passing a second feed air stream entirely through the primary heat exchanger and thereafter passing said second feed air stream from the primary heat exchanger into the higher pressure column.

11. The apparatus of claim 7 further comprising means for passing a second feed stream entirely through the primary heat exchanger and means for passing said second feed stream from the primary heat exchanger into the higher pressure column.

* * * * *